US009058926B2

(12) United States Patent
Bonmann et al.

(10) Patent No.: US 9,058,926 B2
(45) Date of Patent: Jun. 16, 2015

(54) FLUID INSULATED HIGH VOLTAGE COIL

(71) Applicant: ABB TECHNOLOGY AG, Zürich (CH)

(72) Inventors: Dietrich Bonmann, Meckenheim (DE); Thomas Schmidt, Erpel (DE)

(73) Assignee: ABB TECHNOLOGY AG, Zürich (CH)

( * ) Notice: Subject to any disclaimer, the term of this patent is extended or adjusted under 35 U.S.C. 154(b) by 0 days.

(21) Appl. No.: 14/047,299

(22) Filed: Oct. 7, 2013

(65) Prior Publication Data

US 2014/0035710 A1 Feb. 6, 2014

Related U.S. Application Data

(63) Continuation of application No. PCT/EP2012/001087, filed on Mar. 10, 2012.

(30) Foreign Application Priority Data

Apr. 7, 2011 (EP) ..... 11002900

(51) Int. Cl.

| | |
|---|---|
| ***H01F 21/02*** | (2006.01) |
| ***H01F 27/10*** | (2006.01) |
| ***H01F 27/02*** | (2006.01) |
| ***H01F 21/12*** | (2006.01) |

(Continued)

(52) U.S. Cl.

CPC ..... *H01F 27/04* (2013.01); *H01F 27/12* (2013.01); *H01F 30/12* (2013.01); *H01F 29/04* (2013.01); *H01F 27/02* (2013.01); *H01H 9/0005* (2013.01)

(58) Field of Classification Search

CPC ..... H01F 27/04

USPC ..... 336/58, 45, 94, 150

See application file for complete search history.

(56) References Cited

U.S. PATENT DOCUMENTS 1,114,548 A * 10/1914 Stern ..... 336/94
1,435,757 A * 11/1922 Swink ..... 336/146

(Continued)

FOREIGN PATENT DOCUMENTS

EP 1122848 A1 8/2001
EP 2282322 A1 2/2011

(Continued)

OTHER PUBLICATIONS

International Search Report (PCT/ISA/210) mailed on May 7, 2012, by the European Patent Office as the International Searching Authority for International Application No. PCT/EP2012/001087.

*Primary Examiner* — Elvin G Enad
*Assistant Examiner* — Ronald Hinson
(74) *Attorney, Agent, or Firm* — Buchanan Ingersoll & Rooney PC

(57) ABSTRACT

Exemplary embodiments include a fluid insulated high voltage coil having closed tank for an insulation fluid and a high voltage coil arranged therein with at least two taps. An insulation tube extends into the tank, where the inner part of the tube is accessible from an outer side of the tank. Electric contact elements extend through the tube walls along its longitudinal axis, where at least some of the contact elements are electrically connected with the taps. A removable column-like electrical interaction device is arranged within the inner part of the insulation tube, which is electrically connected to the at least two taps by means of the contact elements.

21 Claims, 3 Drawing Sheets

(51) Int. Cl.

| | |
|---|---|
| ***H01F 27/04*** | (2006.01) |
| ***H01F 29/04*** | (2006.01) |
| *H01F 27/12* | (2006.01) |
| *H01F 30/12* | (2006.01) |
| *H01H 9/00* | (2006.01) |

(56) References Cited

U.S. PATENT DOCUMENTS

| | | | | | |
|---|---|---|---|---|---|
| 2,079,843 | A | * | 5/1937 | Dallenbach et al. | 336/10 |
| 2,412,926 | A | * | 12/1946 | Thompson | 361/39 |
| 2,820,953 | A | * | 1/1958 | Cuthbertson | 336/45 |
| 2,917,701 | A | * | 12/1959 | Salton | 361/37 |
| 3,448,422 | A | * | 6/1969 | Derippe | 336/94 |
| 4,135,172 | A | | 1/1979 | Grimes | |
| 4,204,238 | A | * | 5/1980 | Stetson | 361/125 |
| 4,504,811 | A | * | 3/1985 | Stunzi | 336/10 |
| 4,621,298 | A | | 11/1986 | McMillen | |
| 4,803,436 | A | * | 2/1989 | Kresge et al. | 324/549 |
| 8,576,038 | B2 | * | 11/2013 | Kraemer et al. | 336/150 |
| 2010/0109883 | A1 | | 5/2010 | Santos | |
| 2011/0218110 | A1 | * | 9/2011 | Choi et al. | 505/163 |
| 2013/0033349 | A1 | * | 2/2013 | Takano et al. | 336/94 |

FOREIGN PATENT DOCUMENTS

| | | | |
|---|---|---|---|
| GB | 281680 | A | 7/1928 |
| WO | WO 2008/113143 | A2 | 9/2008 |

* cited by examiner

FLUID INSULATED HIGH VOLTAGE COIL

RELATED APPLICATION(S)

This application claims priority under 35 U.S.C. §119 to International. Application PCT/EP2012/001087 filed on Mar. 10, 2012, designating the U.S. and claiming priority to European Application EP 11002900.6 filed in Europe on Apr. 7, 2011. The content of each prior application is hereby incorporated by reference in its entirety.

FIELD

The disclosure relates to a fluid insulated high voltage coil, including a closed tank for an insulation fluid, and a high voltage coil arranged therein with at least two taps.

BACKGROUND

It is known, that transformers are used in electrical distribution networks for coupling network sections of a first voltage level, for example 380 kV, with network sections of a second voltage level, for example 110 kV. Such high voltage transformers might have a rated power of several 100 MVA. Due to reasons of electrical insulation the whole transformer, namely including the transformer core and the transformer coils, can be arranged within a transformer vessel or tank, which is filled with oil or another insulation fluid.

It is also known, that such transformers can be equipped with a tap changer. A tap changer is an electrical switch, wherewith the transmission ratio of a transformer respectively its transformer coils can be modified. A coil with a fixed amount of windings can be electrically connected in series with a coil including several taps, whereas each tap corresponds to a certain number of turns. The tap changer connects the electrical output of such a composite coil with one of the taps and modifies the total number of active turns of the composite coil therewith.

The regulating windings of a tap-coil of power transformers can be sensitive to over-voltages excited by external transient disturbances like lightning or switching surges. For larger regulation ranges and high voltage transformers it is often difficult or even impossible to cope with the resulting voltage stresses by a proper winding design or increased electrical insulation. In such cases it is common practice to connect metal oxide varistors as surge arresters between the conductors leading from the taps of the regulating windings to the tap changer. It is also common practice to assemble a column of a specified number of varistor discs between copper contact pieces. The varistor column is kept under compression by some composite tie rods and springs. The varistor column, or several of them, is mounted inside the transformer tank, under oil, wherever there is space left near the internal electrical connections and tap changer(s).

Disadvantageously within the state of the art is the taps of the transformer coil and also the surge arresters are under oil and are therefore not accessible in a good way. Thus internal surge arresters are not accessible for inspection, replacing or testing without draining oil from the transformer tank. Also a testing or measuring of voltages of the taps is not possible without major effort.

SUMMARY

An exemplary fluid insulated high voltage coil is disclosed, comprising: a closed tank for an insulation fluid; a high voltage coil arranged in the closed tank, the coil having at least two taps; an insulation tube extending into the tank, wherein an inner part of the tube is accessible from an outer side of the tank; and electric contact elements extend through tube walls along a longitudinal axis, wherein at least some of the contact elements are electrically connected with the taps; wherein a removable column-like electrical interaction device is arranged within the inner part of the insulation tube, the electrical interaction device is electrically connected to the at least two taps by means of the contact elements.

An exemplary high voltage transformer is disclosed comprising: a transformer core, at least one high voltage coil having: a closed tank for an insulation fluid; a high voltage coil arranged in the closed tank, the coil having at least two taps; an insulation tube extending into the tank, wherein an inner part of the tube is accessible from an outer side of the tank; electric contact elements extend through tube walls along a longitudinal axis, wherein at least some of the contact elements are electrically connected with the taps; wherein a removable column-like electrical interaction device is arranged within the inner part of the insulation tube, the electrical interaction device is electrically connected to the at least two taps by means of the contact elements, wherein the transformer core and the at least one high voltage coil are arranged in a common tank for an insulation fluid.

BRIEF DESCRIPTION OF THE DRAWINGS

The disclosure will now be further explained by means of an exemplary embodiment and with reference to the accompanying drawings, in which.

DETAILED DESCRIPTION

Figure 1:
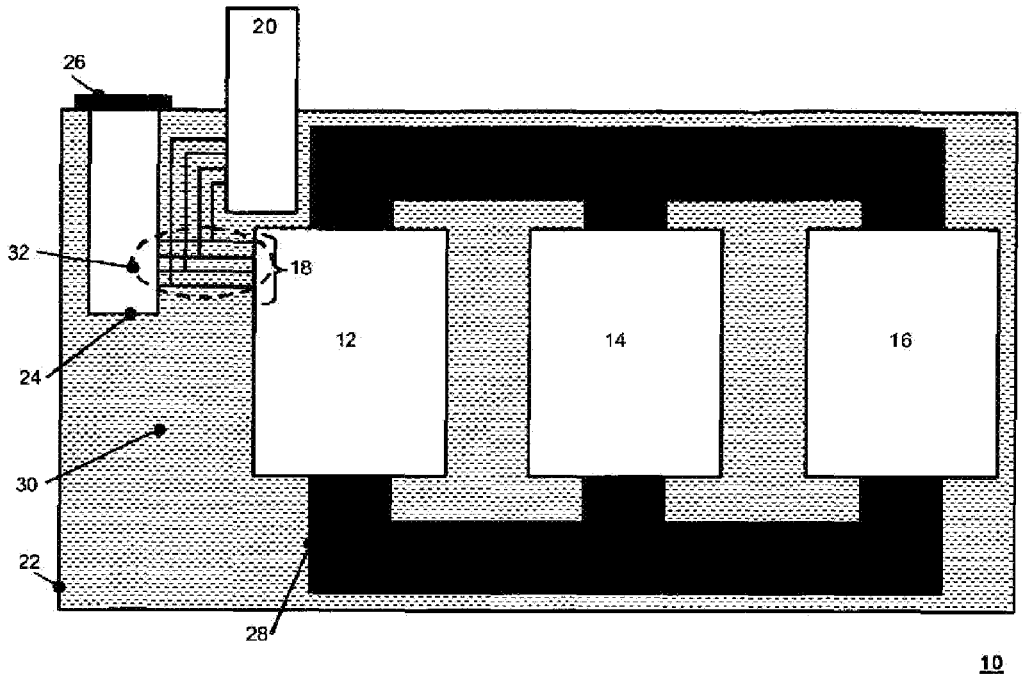
FIG. 1 shows an exemplary high voltage transformer according to an exemplary embodiment of the disclosure.

Exemplary embodiments of the present disclosure provide a high voltage coil, such as a transformer coil with tap changer that allows an easy inspection and replacing of surge arresters or testing under oil. According to exemplary embodiments disclosed herein a high voltage coil is not only limited to a transformer coil and can include any suitable high voltage coil as desired. For example, a high voltage coil, such as a current limiting coil is within the scope of the disclosure.

Exemplary embodiments provide a high voltage coil. Wherein an insulation tube extending into a tank, whereas an inner part of the tube is accessible from an outer side of the tank, electric contact elements are established through the tube walls along its longitudinal axis, at least some of the contact elements are electrically connected with the taps, and a removable column-like electrical interaction device is arranged within the inner part of the insulation tube, which is electrically connected to the at least two taps by means of the contact elements.

Such an insulation tube or composite tube is similar to a tube, which is known from the diverter switch compartment in on-load tap changers for power transformers. This insulation tube should be accessible from outside the tank, for example, from the top of the tank. According to an exemplary embodiment of the disclosure it is possible to open and close a locking device, which normally seals the upper side of the vertically arranged insulation tube, for example. Also the lower side of the tube can be sealed to the tank, so that two different oil spaces are provided, e.g., inside and outside the insulation tube. The insulation tube can be connected with the inner side of a wall of the tank. According to an exemplary embodiment, the insulation tube can be hermetically sealed to the wall. A communication channel in-between both oil spaces can be realized by an U-shaped tube for example, which is mainly arranged outside the tank. This should be seen as part of the upper tank wall. Hence, it is possible to remove or feed in a column-like interaction device into the insulation tube from its open upper end. Electrical contact elements can be configured to extend through the wall of the insulation tube so that inside and outside contact areas are established. The outside contact areas are connected to the taps of the transformer coil. Thus it is possible to connect the interaction device in an easy way to the taps of the high voltage coil, which might be part of a transformer for example. To ensure a safe electrical contact between the contact areas of the electrical interaction device and the corresponding contact areas within the inner hollow space of the insulation tube, e.g., a guiding device is established, which predetermines a fixed end position of the electrical interaction device within the insulation tube. Hence it can be possible to replace or check the removable electrical interaction device which is normally under oil.

Also a current limiter coil, which can be electrically connected in series with another high voltage coil, can be used in connection with exemplary embodiments described herein. Here the two connections of the current limiter coil have to be seen as two taps, which are electrically connected with the insulation tube and the electrical interaction device arranged therein.

According to a further embodiment of the disclosure, the high voltage coil includes (comprises) a tap changer which is electrically connected with the taps of the high voltage coil. Tap changers can produce several over-voltages when operating. Thus it can be useful, to provide an electrical interaction device, which can be used for example, for limiting over-voltages or provide possibilities for measurement.

According to an exemplary embodiment, additional electric contact elements can be provided within the electric interaction device along its longitudinal extension (e.g., axis), where the corresponding longitudinal distances of the additional contact elements are adapted to the longitudinal distances of the first contact elements of the insulation tube. Such additional contact elements can contain copper, since this material is notably suitable for contacts of switches for example. Since the axial distances of the additional contact elements of the electrical interaction device are adapted to the axial distances of the first contact elements of the insulation tube, the electrical interaction device is electrically connected with the taps, if it is fed into the insulation tube.

According to another exemplary embodiment of of the disclosure, at least some of the electric contact elements include a spring-loaded contact section. This improves on one side the electrical contact in-between the contact elements, since a certain pressure force is provided, which is in principal vertical to the longitudinal extension of the electrical interaction device. The spring-loaded electrical contact section might be integrated as well in the contact elements of the electrical interaction device as in the contact elements of the insulation tube. On the other side a gliding of the electric interaction device along the electrical contacts while feeding in or feeding out is simplified in an advantageous manner.

In yet another exemplary embodiment of the disclosure, the electrical interaction device includes stacked surge arrester elements in-between the further electric contact elements. Thus, the surge arrester elements, respectively the whole arrangement of them within the column like interaction device, can easily be removed from the oil tank while the transformer is switched off. In an exemplary embodiment, the surge arrester elements can include varistors, which can have a disc-like shape, for example a diameter of approximately 10 cm for example, and a thickness of some centimeters, dependent on the voltage level they are rated for. According to an exemplary embodiment, the contact elements can have a similar base area as the varistors so that they can become stacked into the column like shape in a suitable manner (e.g., easy way). Dependent on the voltage level to be observed in-between the different taps of the high voltage coil, a stack of five varistors each can be arranged alternating with a contact element. The number of taps of a transformer coil might include 27, for example, so that in total 135 varistors and 28 contact elements would be configured in a column like electric interaction device. A varistor might be configured to have a rated limiting voltage of 1 kV to 5kV, for example.

In still another exemplary embodiment of the disclosure, the elements of the electric interaction device, for example, varistors and contact elements, can be stacked and clamped together at both ends of the stack. This can be done, for example, with one or more insulating screws or fixing elements, whereas both ends of the stack can be configured to include some clamping elements. Those clamping elements can also have a disc like shape with a slightly higher diameter then the stack of the varistors respectively clamping elements. Thus, clamping screws could be fixed on the overlap, which press the whole stack together. It can also be possible to apply a spring force in the longitudinal direction of the stack.

According to an exemplary embodiment of the disclosure, the electrical interaction device includes electrical measurement devices or is at least connected thereto. This is advantageous, for example, in case of maintenance or testing of the transformer respectively high voltage coil on site. Hence, it is possible to feed an electrical interaction device which is connected to measurement devices into the insulating tube. The contact elements are more or less comparable with those of an electric interaction device with surge arresters. The measurement device can be arranged—at least in part—within the interaction device, for example, a voltage sensor. In another exemplary embodiment, the interaction device can contain only measurement lines which are guided to an external measurement and/or analyzing device. Hence, it is possible for example, to analyze the occurring over-voltages during operation of a transformer or current limiter coil for example.

According to a further embodiment of the disclosure, the insulation tube can be arranged approximately vertically and is accessible from the top of the closed tank. An opening within the walls of the tank enables access to the insulation tube without the risk that oil or other insulation liquid leaks out of the tank when the opening is not sealed by a locking device, for example. Thus the whole electric interaction device, for example a clamped stack of 50 disc-shaped varistors, can be moved out the oil tank through the opening on the top. Of course it is also possible to arrange the insulation tube angular, for example in 45°, if this allows a smaller size of the transformer vessel. Most important issue is the accessibility from the top to avoid a leakage of the insulation fluid.

According to another embodiment of the disclosure, a temperature measuring device extends from outside the tank for an insulation fluid into the inner hollow space of the insulation tube. The temperature of the insulation liquid such as oil is information used for the operation of the transformer or other high voltage coils containing components. Surge arrestors or varistors can produce heat in a failure condition.

According to the exemplary embodiments disclosed herein those components can be located within the insulation tube, which builds a substantially (e.g., more or less) closed room. Thus, under a failure condition the temperature of the oil respectively insulation liquid surrounding the surge arresters will rise significantly faster than the temperature of the oil in the remaining part of the tank. This enables the surge arrestors e.g., the varistors to be monitored by means of a temperature measuring device. Since an opening in the tank, transformer vessel, can be used for the accessibility of the insulation e.g., tube, a thermometer, or other temperature measuring device can be implemented, for example, in a locking device for the opening.

The aforementioned advantages of a high voltage coil according to the disclosure are also useable in an advantageous manner for a high voltage transformer including a transformer core and at least one high voltage coil according to the disclosure, which are arranged in a common insulation tank. This is applicable as well for single phase as for three phase transformers.

According to a further embodiment of the disclosure, at least two electrical interaction devices can be included within the same insulation tube. Three galvanic separated electric interaction devices can be arranged in a triangular layout side by side to connect three galvanic separated electric interaction devices in series within the same insulation tube.

According to an exemplary embodiment of the disclosure, the tank can be filled with an insulation liquid such as oil, for example. This enables the high voltage component to be operated with the rated voltage. The insulation tube is not hermetically closed, thus the not used space of the insulating tube is also filled with the insulation liquid under normal operation conditions.

FIG. 1 shows an exemplary high voltage transformer according to an exemplary embodiment of the disclosure. FIG. 1 shows an exemplary three phase high voltage transformer in a sectional view 10. Around the three limbs of a transformer core 28 a high voltage coil 12, 14 respectively 16 is arranged, whereas all of them include several taps, which are only shown for the first high voltage coil 12 with the reference number 18. In an exemplary embodiment, the transformer can include several tabs, such as sixteen or eighteen. The tabs can be electrically connected by means of electrical connection means 32 as well with a first insulation tube 24 as with a tap-changer 20, which is indicated by a single box. All those components are arranged within a closed tank 22, a transformer vessel, which is filled with an insulation fluid 30, in this case oil. The tank 22 include in its upper wall an opening, where through the insulation tube is accessible. This opening is closable by a locking device 26, for example, a metal plate with a seal, which can be screwed on the upper side of the tank 22, which can be made from metal.

Figure 2:
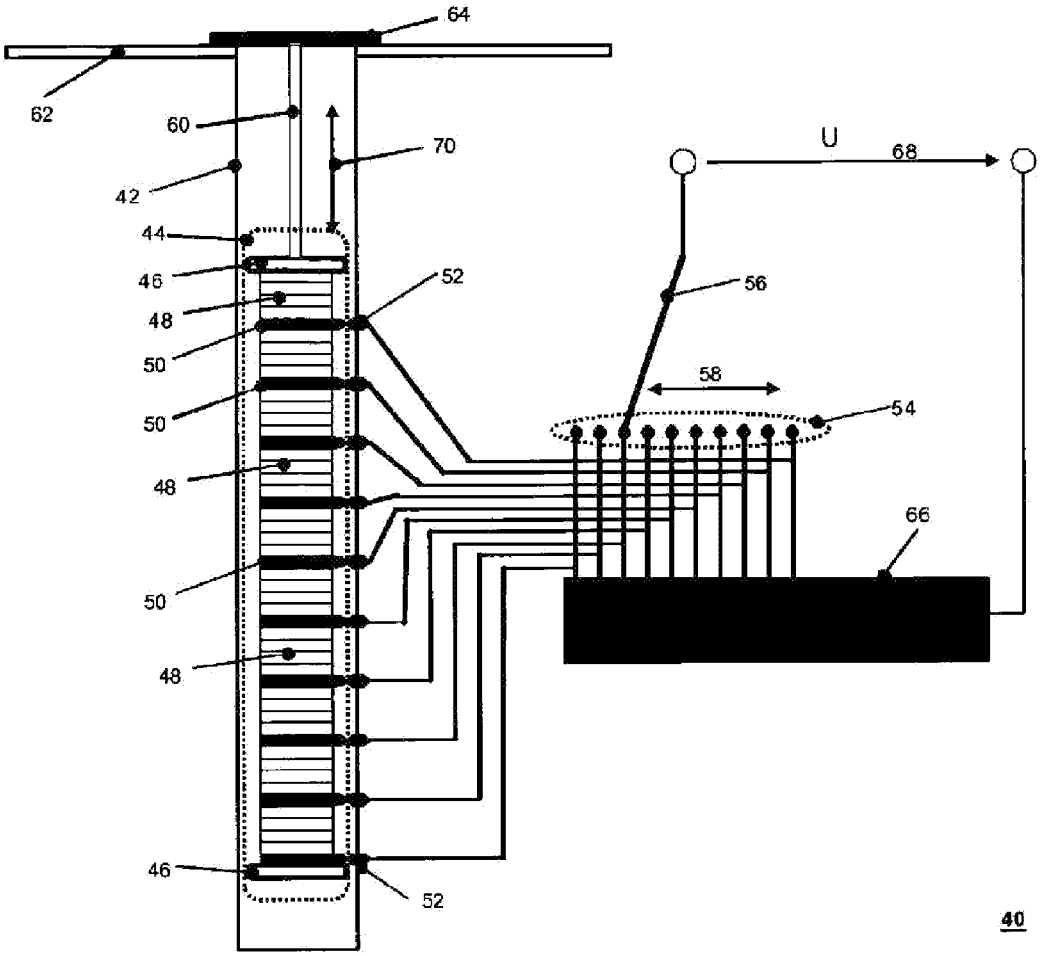
FIG. 2 shows an exemplary first electric interaction device with adjacent components according to an exemplary embodiment of the disclosure.

FIG. 2 shows an exemplary first electric interaction device with adjacent components according to an exemplary embodiment of the disclosure. FIG. 2 shows an exemplary first electric interaction device with adjacent components in a view 40. This can be used in part for example within the transformer shown in FIG. 1. An insulation tube 42 is accessible through an opening of a top wall 62 of a tank for insulation fluid. The insulation tube 42 is mounted by a screw-joint on the top-wall 62. A removable locking device 64 is sealing this opening, so that it is hermetically closed during operation of the components. A first electric interaction device 44 is arranged within the tubular inner hollow space of the insulation tube 42. This includes a column-like stack of four disc-shaped surge arrestors 48 respectively varistors each alternating with further contact elements 50, which are can be made from copper. Both axial ends of the electric interaction device 44 are bordered by disc-shaped clamping elements 46, whose diameter is larger than the diameter of the varistors 48. Both clamping elements 46 are pressed together with insulating screws (not shown), which are arranged around the stack. In another exemplary embodiment, the stack can be pressed by a spring, which can be arranged in-between the upper clamping element 46 and the top wall 62.

The shape of the electric interaction device 44 including the screws can be adapted to the inner diameter of the insulating tube 42, including axial guiding elements. Thus, the electric interaction device can only be moved up and down along the arrow with the reference sign 70. As shown in FIG. 2, the locking device 64 and the whole interaction device 44 are connected with a rod 60 together, so that the interaction device is fixed in an operating position.

FIG. 2 also shows a high voltage coil 66. This might be each kind of high voltage coil such as a transformer coil but also a current limiting coil or similar. Several taps of this coil are indicated with the reference sign 54. Those tabs 54 are electrically connectable with a tap changer 56, which can selectively connect a tap with an electrical output of the coil, whose output voltage is indicated with the reference sign 68. The taps furthermore are connected with electric contact elements 52 that can be equidistantly arranged along the axial extension through the wall of the insulation tube 42. Those contact elements 52 can electrically connect the tabs 58 with the contact elements 50 of the electric interaction device 44. The contact elements 50 of the electric interaction device and/or the contact elements 52 of the insulation tube 42 can have a spring-like characteristic, so that a force is applied in-between both contact elements 50, 52, so that a secure electric contact is realized.

Figure 3:
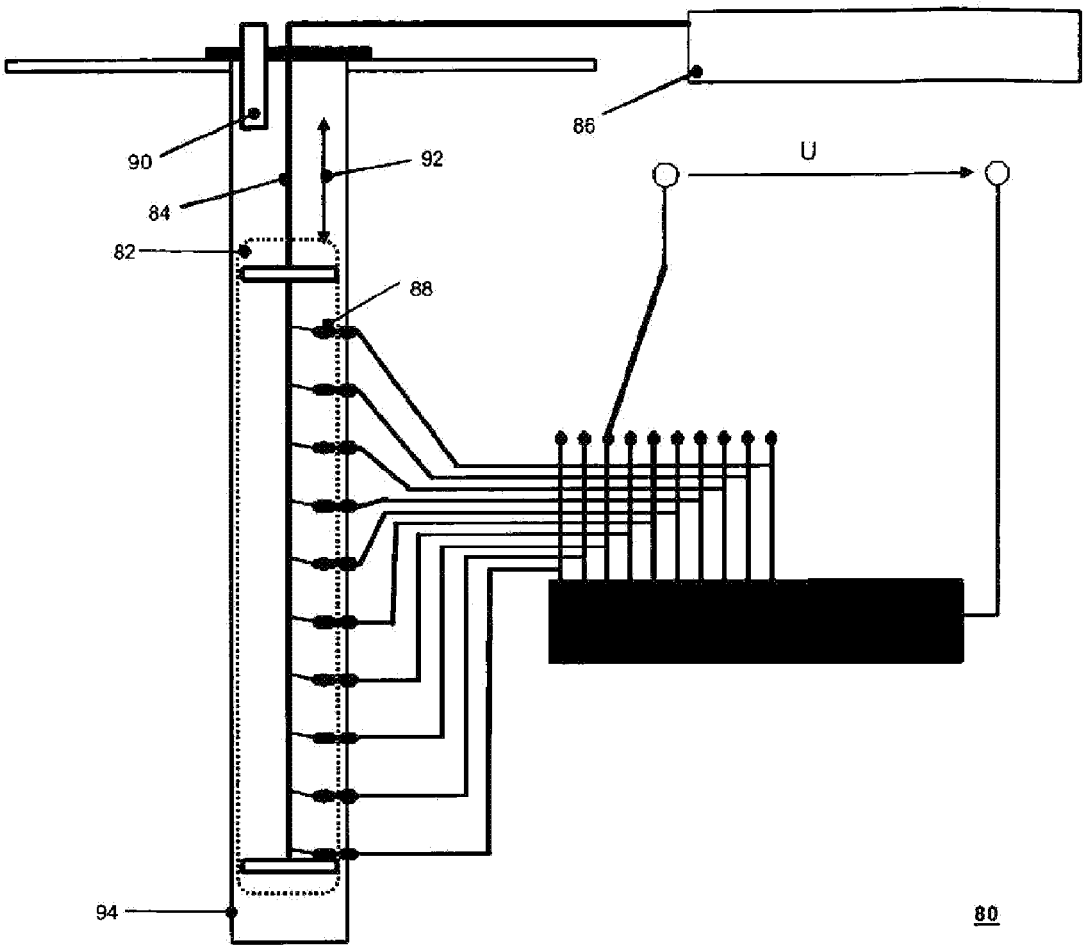
FIG. 3 shows an exemplary second electric interaction device with adjacent components according to an exemplary embodiment of the disclosure.

FIG. 3 shows an exemplary second electric interaction device with adjacent components according to an exemplary embodiment of the disclosure. FIG. 3 shows an exemplary second electric interaction device with adjacent components in a view 80. The main difference is that not a varistor-based first interaction element has been fed into the insulation tube 94, but a second interaction element 82, that includes more or less only connection lines 84 in-between contact elements 88 and external electric measurement devices 86. Thus, it is possible to easily measure the voltage at the taps of the transformer without major effort. This might be useable for test purposes on site. Afterwards, the second interaction device for measurement 82 might be replaced by a varistor-based interaction device before the high voltage coil respectively the transformer is switched back to normal operation. Additionally, the electric interaction device can include a thermometer 90, which extends from outside the tank into the inner hollow space of the insulation tube 94.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

10 exemplary high voltage transformer
12 first high voltage coil
14 second high voltage coil

16 third high voltage coil
18 taps of first high voltage coil
20 first tap changer
22 closed tank
24 first insulation tube
26 first locking device
28 transformer core
30 insulation fluid
32 electrical connection
40 exemplary first electric interaction device with adjacent components
42 second insulation tube
44 first electric interaction device
46 clamping element
48 stacked surge arresters
50 further electric contact element
52 electric contact element
54 taps of forth coil
56 second tap changer
58 movement direction of second tap changer
60 rod
62 top wall of closed tank
64 second locking device
66 fourth high voltage coil
68 voltage
70 movement direction of first electric interaction device
80 exemplary second electric interaction device with adjacent components
82 second electric interaction device
84 data transmission cable
86 electrical measurement devices
88 second further contact element
90 thermometer
92 movement direction of second electric interaction device
94 third insulation tube

What is claimed is:

1. A fluid insulated high voltage coil, comprising:

a closed tank for an insulation fluid;

a high voltage coil arranged in the closed tank, the coil having at least two taps; and an insulation tube extending into the tank, wherein an inner part of the tube is accessible from an outer side of the tank, the insulation tube including:

first electric contact elements that extend through tube walls along a longitudinal axis, wherein at least some of the electric contact elements are electrically connected with the taps; and a removable column-shaped electrical interaction device is arranged within the inner part of the insulation tube, and has second electric contact elements arranged to form a secure electric contact with the first electric contact elements, wherein the electrical interaction device is electrically connected to the at least two taps by means of the first and second electric contact elements.

2. The fluid insulated high voltage coil according to claim 1, comprising:

a tap changer which is electrically connected with the taps of the high voltage coil.

3. The fluid insulated high voltage coil according to claim 1, the second electric contact elements within the electric interaction device are arranged along a longitudinal axis of the electrical interaction device, wherein distances between the second electric contact elements are adapted to distances between the first contact elements of the insulation tube.

4. The fluid insulated high voltage coil according to claim 1, wherein at least some of the first electric contact elements comprise a spring-loaded contact section.

5. The fluid insulated high voltage coil according to claim 3, wherein the electrical interaction device comprises stacked surge arrester elements in-between the second electric contact elements.

6. The fluid insulated high voltage coil according to claim 5, wherein the surge arrester elements are varistors.

7. The fluid insulated high voltage coil according to claim 3, wherein clamping elements of the electric interaction device are stacked and clamped together at both ends of the stack.

8. The fluid insulated high voltage coil according to claim 4, wherein clamping elements of the electric interaction device are stacked and clamped together at both ends of the stack.

9. The fluid insulated high voltage coil according to claim 5, wherein clamping elements of the electric interaction device are stacked and clamped together at both ends of the stack.

10. The fluid insulated high voltage coil according to claim 1, wherein the electrical interaction device comprises electrical measurement devices or is at least connected to electrical measurement devices.

11. The fluid insulated high voltage coil according to claim 2, wherein the electrical interaction device comprises electrical measurement devices or is at least connected to electrical measurement devices.

12. The fluid insulated high voltage coil according to claim 3, wherein the electrical interaction device comprises electrical measurement devices or is at least connected to electrical measurement devices.

13. The fluid insulated high voltage coil according to claim 1, wherein the insulation tube is arranged approximately vertically and is accessible from the top of the closed tank.

14. The fluid insulated high voltage coil according to claim 2, wherein the insulation tube is arranged approximately vertically and is accessible from the top of the closed tank.

15. The fluid insulated high voltage coil according to claim 1, wherein a temperature measuring device, which extends from outside the tank for an insulation fluid into the inner space of the insulation tube.

16. The fluid insulated high voltage coil according to claim 2, wherein a temperature measuring device, which extends from outside the tank for an insulation fluid into the inner space of the insulation tube.

17. A high voltage transformer comprising:

a transformer core, a closed tank for an insulation fluid;

at least one high voltage coil arranged in the closed tank, the coil having at least two taps; and an insulation tube extending into the tank, wherein an inner part of the tube is accessible from an outer side of the tank, the insulation tube including:

first electric contact elements that extend through tube walls along a longitudinal axis, wherein at least some of the electric contact elements are electrically connected with the taps; and a removable column-shaped electrical interaction device is arranged within the inner part of the insulation tube, and has second electric contact elements arranged to form a secure electric contact with the first electric contact elements, wherein the electrical interaction device is electrically connected to the at least two taps by means of the first and second electric contact elements, and wherein the transformer core and the at least one high voltage coil are arranged in a common tank for an insulation fluid.

18. The high voltage transformer according to claim 11, comprising no less than three high voltage coils.

19. The high voltage transformer according to claim 11, wherein at least two electrical interaction devices are arranged within the same insulation tube.

20. The high voltage transformer according to claim 11, wherein the common tank is filled with an insulation fluid.

21. The high voltage transformer according to claim 2, wherein the tap changer is external to the insulation tube.

* * * * *